United States Patent [19]

Watson

[11] 4,121,895

[45] Oct. 24, 1978

[54] KINETIC ENERGY TYPE PUMPING SYSTEM

[76] Inventor: John P. Watson, P.O. Box 711, Luling, Tex. 78648

[21] Appl. No.: 759,959

[22] Filed: Jan. 17, 1977

[51] Int. Cl.[2] ..... F04F 7/00

[52] U.S. Cl. ..... 417/104; 137/119; 417/240

[58] Field of Search ..... 417/240, 226, 104, 241, 417/77; 137/119

[56] References Cited

U.S. PATENT DOCUMENTS

| | | | |
|---|---|---|---|
| 1,845,139 | 2/1932 | Exley | 137/119 X |
| 2,444,912 | 7/1948 | Bodine | 417/53 |
| 3,007,491 | 11/1961 | Evans | 137/119 X |
| 3,123,009 | 3/1964 | Watson | 417/240 |

*Primary Examiner*—Carlton R. Croyle
*Assistant Examiner*—R. Gluck
*Attorney, Agent, or Firm*—Fulbright & Jaworski

[57] ABSTRACT

The present invention relates to improvements on an "inertia" type pumping system (actually using kinetic energy) including elimination of springs in the valves, include pressure dampening or cushioning means for dampening sharp liquid pressure rises inherent in an inertia type pump, and discharge of pumped fluid directly into a tank rather than through a circulation pump of the system, all of which results in longer pump life, less down time for repairs, smoother, quieter and more efficient operation, and avoids shutdown of the inertia pumping system by eliminating gas entering the circulation pump when pumping oil having entrained gas from a formation.

4 Claims, 1 Drawing Figure

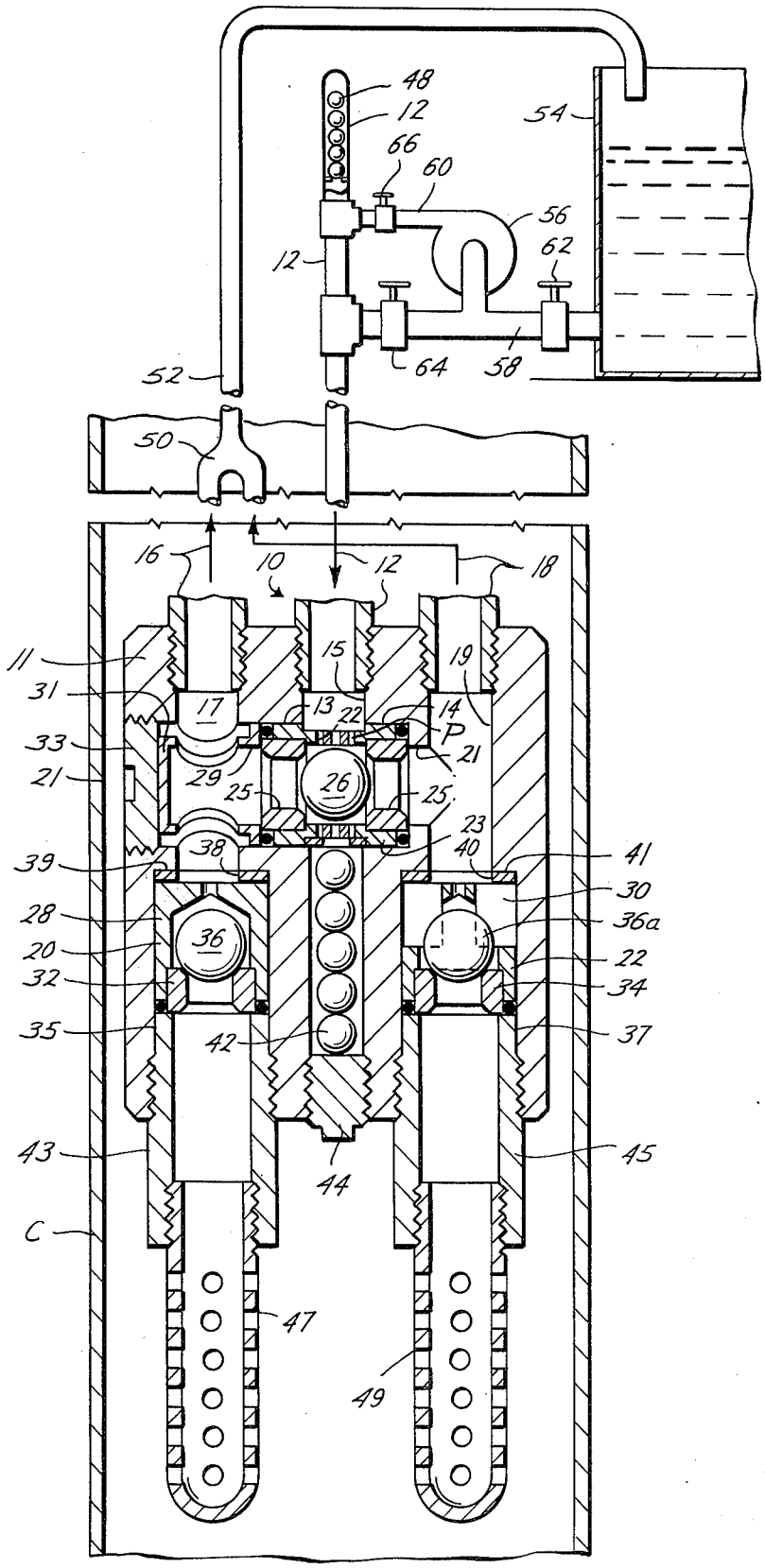
48
12
54
66
60
56
62
12
64
58
52
50
16
10
12
18
11
15
19
31
17
13
22
14
P
33
21
21
29
25
26
25
23
39
38
40
41
30
28
36
36a
20
22
32
34
35
42
37
43
44
45
C
47
49

KINETIC ENERGY TYPE PUMPING SYSTEM

BACKGROUND OF THE INVENTION

While the earlier (kinetic energy) type pumping system of my U.S. Pat. No. 3,123,009, has a number of advantages over other pumping systems as set forth in that patent and would function satisfactorily, experience in the operation of my prior inertia type pump system indicated a need for changes, which were made by me, to improve the practicality, reliability and efficiency of the inertia type pumping system and to prolong its life with less down time for repairs and the like.

In kinetic energy pumping systems, a double acting valve is utilized at the juncture adjacent the lower ends of the input and return lines. In my earlier kinetic energy pumping system illustrated in my U.S. Pat. No. 3,123,009, compression springs were utilized to position the ball midway between the valve seats so that at the start of flow of circulation, fluid began to flow through each of the valves and cause the double acting valve to commence working automatically. In addition, the check valves, which were spring-loaded, must open and close very rapidly because the pumping cycles of the inertia pump occur very rapidly. Consequently, the valve springs had a relatively high wear rate and weakened and broke frequently, necessitating replacement of broken springs.

Also while there is a substantially continuous flow of fluid in the kinetic pumping system when in operation, there are constantly occurring fluctuations in the rapidity of liquid flow and pressures, especially adjacent the lower ends of the input and return lines, which results in sharp momentary intermittent liquid pressure rises and drops, causing stress and strain on the pump system, noise and vibration and wear and tear on the system generally.

In addition, when the kinetic energy pumping system is utilized to pump oil from formations having gas, which gas is entrained in the the oil, the delivery of oil including gas back to the circulation pump causes the circulation pump of the system to fail to circulate fluid and consequently the inertia pump system is shut down. Also, discharging pumped liquid into the circulation pump causes considerable wear and tear on the circulation pump due to pressure fluctuations in the liquid being discharged.

While the inertia (kinetic energy) pumping system from my prior U.S. Pat. No. 3,123,009, was and is highly advantageous for the reasons and purposes set forth therein, it would be a distinct advance in the art of kinetic energy type pumps to avoid the use of springs in the double acting valves and check valves, thereby providing a much longer life and less down time for repairs and more rapid opening and closing of valves, to include means which cushion or dampen the sharp intermittent shocks inherent in the system to provide quieter and smoother operation, and to eliminate any inflow of gas from formations being pumped into the inertia type circulation pump thereby eliminating shutdowns therefrom, and unnecessary wear and tear on the circulation pump, all of which would result in a greatly improved and efficient inertia type pumping system, and one which can be used in all applications, such as pumping water from wells, oil from gas wells and including entrained gas, for both shallow and deep pumping operations, and from one location to another.

SUMMARY OF THE INVENTION

The present invention relates to an improved kinetic energy type pumping system. More particularly, the present invention relates to a kinetic energy type pumping system of the type as disclosed in my earlier U.S. Pat. No. 3,123,009, but which eliminates the use of springs in the check and double acting valves, thereby eliminating down time and repairs due to spring failures and increasing the rate of operation, which includes cushioning or dampening means for dampening the sharp intermittent pressures inherent in the pump system thereby providing a smoother and more efficient operation, and eliminates discharge of pumped liquid gas into the circulation pump thereby eliminating shutting down of the pump when gas is present, all of which provides a greatly and distinctly improved inertia type pumping system from the standpoint of operation, less wear and tear and down time for repairs, and increased efficiency.

The compression springs have been removed and rendered unnecessary in the check valves by removing relatively large areas of the sides of the valve ball cages so that large surface areas of the valve balls are exposed to the direct line flow of the fluid circulating in the system. This results in very rapid closing and opening of the check valves since the dampening effect of the springs is eliminated, and greatly reduces wear and tear in normal usage thereby avoiding down time and repairs for spring failures.

The double acting valve blocking assembly avoids the use of springs by providing horizontally aligned, opposed valves seats upon which the valve ball alternately seats and includes circulating fluid contact completely around the valve ball. Thus, in alternate pressure and suction cycles the valve ball rapidly moves from one of the aligned valve seats to the other without the necessity of using springs, with the attendant spring wear and spring problems.

The improved kinetic energy pumping system of the present invention has its discharge line delivering pumped liquid into a suitable tank or container, and not into the circulation pump as illustrated in my U.S. Pat. No. 3,123,009, which eliminates shocks and pressure strains on the circulation pump which occur each pumping cycle, and, when gas is entrained in the liquid being pumped from oil formations, the gas does not enter the circulation pump and cause it to fail, but is discharged into the tank or other container and separated in the usual manner.

Inherent in kinetic energy pumping systems as disclosed in my previous U.S. Pat. No. 3,123,009, are sharp, intermittent liquid pressure rises caused by having the circulation fluid being abruptly blocked each time a check valve ball seats on its check valve seat which causes noise, vibration and considerable stress and strain on the entire inertia pumping system. The present invention minimizes this noise, vibration and stress and strain by providing pressure dampening or cushioning means at the bottom and at the top of the circulation input line which results in easier, smoother, quiet pumping operations and less vibration, wear and tear on the entire inertial pumping system, thereby providing greater pumping efficiency and prolonging the useful life of the circulation pump as well as other downhole pump equipment.

It is therefore an object of the present invention to provide an improved kinetic energy type pumping system which provides smoother, quieter, more efficient and trouble-free operation with less wear and tear on the various pump components resulting in longer life and less down time for repairs and servicing.

A further object of the present invention is the provision of a kinetic energy energy type pumping system in which springs are eliminated from the check valves and double acting blocking valve, thereby resulting in improved and faster operation and eliminating spring problems, such as repairs and down time necessitated by spring failures.

A further object of the present invention is the provision of an improved kinetic energy pumping system which eliminates springs from the check valves and double acting blocking valve thereby providing faster opening and closing valves than is possible when utilizing springs with the valves.

A further object of the present invention is the provision of an improved kinetic energy pumping system which includes cushioning or dampening means for dampening the sharp intermittent pressures inherent in such pumping systems thereby providing a smoother and more efficient operation and less wear and tear on all of the pump components.

A further object of the invention is the provision of an improved kinetic energy type pump in which the discharge line discharges liquid into a tank or other suitable receptacle rather than into the circulating pump as illustrated in my U.S. Pat. No. 3,123,009, thereby minimizing wear and tear on the circulation pump and eliminating shutting down of the circulating pump when gas is entrained in the liquid, such as when pumping oil from formations having gas, and in which the oil and gas are readily separated by gravity or other suitable means conventional in the art.

A further object of the present invention is the provision of an improved kinetic energy type pump which is relatively inexpensive to manufacture and operate, which is highly efficient, and which can be utilized for pumping liquid from well bores, both at shallow and very deep depths, or from any source to any destination.

Other and further objects, features and advantages of the invention appear throughout.

BRIEF DESCRIPTION OF THE DRAWING

The drawing is a side elevation, partly in section, partly diagrammatic, illustrating an improved kinetic energy type pumping system according to the invention and shown in place in casing for pumping fluid from a formation traversed by a well bore.

DESCRIPTION OF PREFERRED EMBODIMENTS

Referring now to the drawing, the numeral 10 generally designates the improved kinetic energy pumping system of the present invention having the pump body 11 and generally comprises a circulation system which includes an input line 12 through which a continuous circulation liquid is pumped to a double acting liquid flow blocking valve 14 disposed in a horizontally extending bore 13 in the pump body 11 by which the circulating fluid can be directed to either return line 16 or return line 18. The pump body 11 is provided with the vertically extending bores 15, 17 and 19 into which the input line 12 and the return lines 16 and 18, respectively, are threadedly secured. The bores 17 and 19 extend downwardly and have fluid communication with the horizontally extending bore 13, and are in fluid communication with the check valves 20 and 22, so that a circulation liquid introduced in the input line 12 is alternately directed to the bores 17 and 19 and their respective check valves 20 and 22 and to the return lines 16 and 18, respectively.

The horizontally extending bore 13 intersects the bores 17 and 15, and has a reduced diameter that approaches the bore 19 to provide the annular shoulder 21 against which the valve cage 23 stops. The valve cage 23 is provided with the removable annular valve seats 25, which are horizontally aligned, and against which the valve ball 26 alternately seats upon circulation of liquid in the input line 12, as will be explained in more detail later. Both valve seat members 25 are removable and reversible and are stopped and retained in place at their inner ends by the opposed and outwardly facing annular shoulders 27 in the valve cage 23. The valve seat member 25 on the left, as the drawing is viewed, is retained in place by the shoulder 29 on the sleeve-like member 31, the entire double acting valve assembly being retained in place by the threaded plug 33 pressing it against the annular shoulder 21. As illustrated, suitable packing means are provided for the blocking valve 14, which blocking valve can readily be removed by unthreading the plug 33 and sliding out the various components for quick repair and replacement of parts. The sleeve member 31 is provided with openings communicating with the bore 17 in the valve body 11 to provide circulation of liquid through the blocking valve 14 into the vertical bore 17 to the check valve 20 and return line 16.

The liquid passageway through the valve seats 25 are extremely short before the liquid enters the passageways 17 and 19, and the blocking valve cage 13 is undercut in the middle at its outer side so that liquid from the line 12 passes completely around the valve cage 13. perforations P, or other openings, are provided in the middle portion of the valve cage 13 so that liquid from the inpuet line 12 can flow through the perforations P to the inside of the valve cage 13 from all directions against the valve ball 26 thereby centering it in the cage 13.

To assemble and install the blocking double acting valve assembly, the blocking valve 14 is assembled as illustrated and simply moved into the horizontal bore 13 until the right valve seat member 25 is firmly against the annular shoulder 21. The retaining sleeve 31 is then inserted with its annular shoulder 29 against the outer shoulder of the left valve seat member 25 and the threaded plug 33 is then screwed into place which applies pressure against the retainer sleeve 31, which in turn applies pressure against the valve cage 13 and causes the O-ring type packing elements to be deformed into sealing engagement with their surrounding parts, all as illustrated in the drawing. To remove the blocking valve assembly 14, the steps are simply reversed.

The vertical bores 17 and 19 in the kinetic pump body 11 are counterbored attheir lower portions 35 and 37 to provide bores of slightly larger diameter than their communicating bores 17 and 19, respectively, which form the downwardly facing annular shoulders 39 and 41 against which the check valve assemblies 20 and 22, respectively, are positioned. The lower portions of the counter-bores 35 and 37 are threaded, to threadedly receive the downwardly extending pipes 43 and 45 into which are threaded the liners 47 and 49 through which liquid from the formation traversed by the bore hole, not shown, is pumped, which normally would be cased by the casing C.

The right check valve assembly 22 has been rotated 90° from the left check valve 20 for purposes of illustration and a more completely disclosure. The check valves 20 and 22 may be positioned in the counterbores 35 and 37 in this rotated position, or both of them may be positioned as illustrated in either the right or the left views of the check valves.

The check valves 20 and 22 have the valve cages 28 and 30, respectively, which are provided with removable valve seats 32 and 34. The opposite sides of the valve cages 28 and 30 are substantially cut away to provide free fluid communication with liquid in the passages 17 and 19, respectively. The check valve balls 36 and **36*a* have a relatively short movement and have large surface areas exposed to fluid in the passages 17 and 19 through the cut-out portions of the valve cages 28 and 30, which is best illustrated in the right-hand view of these check valves 20 and 22**.

Even though the sides of the check valve cages 28 and 30 have been removed, enough of the curving metal of the valves cages 28 and 30 is left to confine the check valve balls 36 and **36*a*, yet large surface areas of these check valves balls protrude outside the central portion of the valve cages 28 and 30. This makes for very fast valve closures and openings due to the unique exposure of large surface areas of the valve balls 36 and 36*a***, and without the dampening effect of springs, which are unnecessary and are not used with these check valves.

Suitable ring-like sealing members 38 and 40 are provided against the shoulders 39 and 41 of the valve body 11 against which the valve cage bodies 28 and 30 are positioned, and these bodies, along with the valve seat members 32 and 34, which shoulder against downwardly facing annular shoulders formed by counterboring the lower inner ends of the valve cage bodies 28 and 40, are securely held in place by threading the pipes 43 and 45 into the counter bores 35 and 37 of the passages 17 and 18, respectively.

To assemble the check valves 20 and 22, they are assembled as illustrated and simply moved upwardly into the counterbores 35 and 37, the pipes 43 and 45 are then threaded into the lower ends of the counterbores until their upper ends engage the lower ends of the valve seats 32 and 34. Continued inwardly threading of the pipes 43 and 45 causes the packing members 39 and 41 and the O-rings to be deformed into sealing engagement with their surrounding parts. To remove the check valves 20 and 22, the steps are simply reversed.

The sharp, intermittent pressure rises and drops inherent in kinetic energy type pumps are dampened or cushioned by extending the vertical bore 15 in the pump body 11 downwardly and providing resilient solid material in this passageway, such as the resilient rubber balls 42, which are retained in place by the threaded plug 44 threaded into the lower portion of the vertical bore 15. A similar extension of the inpuet line 12 is provided at its upper end into which are inserted solid resilient material, such as the rubber balls 48. Thus, both the top and the bottom of the input line 12 have cushioning or dampening means which cushion or dampen the constantly occurring pressure fluctuations, especially at the lower end of the input line 12, which is here the bore extension 15, and to a lesser extent at the top of the line 12. These pressure fluctuations originate in the input line 12 where there is liquid communication with the intake of the double acting blocking valve 14, since the immediate previous liquid travel path of the circulating liquid is abruptly blocked by the alternate seating of the ball 26 on the valve seats 25 of the double acting valve 14 and the alternate seating of the check valve balls 36 and **36*a* on their respective valve seats 32 and 34 which almost immediately places into movement all the return fluid through a different circulation return line 16 or 18. This causes sharp, momentary liquid pressure rises in the lower portion of the line 12, which are very objectionable, causing stress and strain on the entire inertia pumping system 10, the input line 12 and the circulation pump, later described. The pressure dampening results in an easier, smoother, quieter pumping operation as soon as the circulation flow begins which results in less vibration, wear and tear on the entire inertia pumping system, greater pumping efficiency and prolongs the useful life of the circulation pump as well as other components of the inertial pumping system 10**.

The return lines 16 and 18 are connected together by a pressure connection and exchanger 50 to provide discharge in lines 16 and 18 to flow into the common discharge line 52 which delivers the pumped fluid into the upper portion of the tank 54 or other suitable receptacle. Thus, pumped liquid is not discharged into the circulation pump 56 but into the upper portion of the tank 54 which thereby minimizes wear and tear on the circulation pump 56 and avoids entry of gas into the circulation pump 56 thereby avoiding possible shutdowns of the entire system and permitting separation of the gas from the liquid by gravity or other suitable means, not shown, when pumping oil having entrained gas.

The liquid circulating pump 56 may be of any desired type, and is connected by the valved line 58 to the bottom of the tank 54 and by the valved line 60 into the upper end of the input line 12. The liquid circulating pump 56 provides a constant flow of liquid from the bottom portion of the tank 54 into the input line 12.

To start operating the kinetic pumping system 10, a quantity of liquid, for example, water, is placed in the tank 54, the valve 62 is opened, the valve 64 is closed, and the valve 66 is opened. Any type of liquid which will readily separate from the fluid being pumped can be used instead of water. The circulation pump 56 is started and the liquid from the tank 54 is thus pumped by the circulation pump 56 into the upper portion of the input line 12 which enters the automatic fluid blocking valve 14 to start working automatically, that is, causing the valve ball 26 to alternately seat on the horizontally aligned and opposed valve seat members 25. The circulating liquid returns through the return flow suction and ram lines 16 and 18 together with the liquid pumped from the well bore through the check valves 20 and The mixture of the circulating liquid and the fluid pumped from a formation in the well bore passes upwardly through these return lines 16 and 18 and combine in the liquid pressure exchange fixture 50 from which the liquid mixture passes into the common discharge line 52 and into the upper portion of the tank 54. If the fluid being pumped is from a formation containing oil and gas, the mixture will consist of oil, some of the circulating water, and entrained gas. Before the circulating pump 56 has been operating very long there will be a considerable difference in the weight of the circulating liquid flowing downwardly in the input line 12 and through the double acting blocking valve 14 and the weight of the fluid flowing upwardly in the return and discharge lines 16, 18 and 52. The weight of the fluid mixture in the upflow or return lines 16, 18 and 52 is much lighter than the weight of the water in the input line 12 flowing downwardly into the system, and, for convenience, that difference is termed a "gravity differential" between the upflow and downflow in the system and is sufficient to power the operation of the pumping system without the use of the circulating pump 56, at which time the circulation pump 56 is stopped, the valve 64 is opened and the valve 66 is closed. Now the circulating water from the bottom of the tank 54 flows directly through the valves 62 and 64 in the flow line 58 and down into the input line 12 bypassing the circulation pump 56 which has been turned off. The gravity differential produces sufficient power or force to continue the kinetic pumping operation almost indefinitely. In the event the gravity differential becomes too great and the pumping system begins to operate too fast, it can be slowed by partially closing or choking the valve 64. Thus, the kinetic pumping system 10 can be used for pumping oil to the surface, with large savings of energy and expense.

The foregoing action is not one of perpetual motion, but results from properly controlling the release of energy of light fluids that have been under great pressures in formations in the earth for millions of years. The oil and gas is not diminished in volume and value when it is delivered into the tank 54, but the kinetic energy pumping system makes valuable use of the harnessed energies of the light mineral fluids in formations traversed by well bores.

In operating the kinetic energy pumping system for pumping water from water wells, the circulation pump 56 is continually operated to provide circulation of the circulating liquid, but even in this circumstance, relatively small amounts of energy are used in operating the circulating pump for the amount of water pumped from such wells.

Upon starting the circulating flow through the circulation pump 56, the valve ball 26 in the double acting blocking valve 14 at first remain slightly below the entrances of the valve seats 25 and permits the circulating liquid to flow through each valve seat and up the return lines 16 and 18 simultaneously. The turbulent circulation flow around the valve ball 26 does not allow it to remain very long in its former position, which was slightly below and away from the valve seats 25, but quickly centers and forces the check valve ball 26 to one or the other of the valve seats 25. Assuming that the valve ball 26 first rested upon the left valve seat 25, the liquid pressure of the circulating liquid will hold it against that seat and, in this instance, the flow of circulating liquid through the return line 16 is abruptly and immediately discontinued. This causes a ram effect at the top of the line 16 due to the inertia of the moving circulating liquid in that line at its upper end while at the same time a negative pressure or suction occurs in the lower end of the return line 16, causing the opening of the check valve 20, at which time fluid from a formation traversed by the well bore enters through the liner 47, advances upwardly through pipe 43, through the check valve 20 and into the lower end of the return or discharge line 16. When the kinetic energy or ram force in the return line 16 is spent, the liquid pressure within the lower end of the return line 16 will increase, closing the check valve 20 and also creating a liquid force against the side of the exposed outer surface of the valve ball 26 that is resting on the left valve seat 25, causing the ball 26 to be forced from that valve seat. The circulating liquid from the input line 12 at this time causes the valve ball 26 to move immediately to the right valve seat 25. The reason that there is a liquid pressure sufficient to move the ball 26 from the left valve seat 25 to the right valve seat 25 is that after the kinetic energy of the liquid in return line 16 has been spent, the increasing liquid pressure from line 18 rises, since all of the circulation liquid at that instant is taking place through the line 18, and the lines 16 and 18 being in liquid communication with each other at their top ends, liquid passes downwardly through return line 16 temporarily. At the time the ball 26 is seated on the left valve seat 25, the check valve 22, which is in fluid communication between the return line 18 and the fluid in the well bore, fluid flows up from the well bore through the line 49, the check valve 22 and up the return line 18. When the kinetic energy or ram force in the return line 18 is spent, the valve ball 26 will be forced over against the left valve seat 25, in the same way that the ball 26 was forced from the left valve seat 25 to the right valve seat 25. Thus, a continuous return cycle operating automatically by the force of the circulating liquid is provided to actuate the double acting blocking valve 14 and the check valves 20 and 22.

Field testing of an improved kinetic energy type pumping system of the present invention has established that the pumping operation is smooth, quiet, very efficient, shut-downs are avoided due to any spring failures, there is less wear and tear on the pump system and its components, and shut-downs were avoided when pumping oil from formations having gas entrained in the oil. The field testing also established that the double acting blocking valve 14 and check valves 20 and 22 operated sufficiently rapidly to be very satisfactory in pumping fluids from well bores by the improved kinetic energy type pumping system.

While the present invention has been described in connection with pumping fluid from a well bore, the invention may be utilized for pumping liquids from any source to any destination and may be used to pump any desired fluid.

The present invention, therefore, is well adapted and suited to carry out the objects and attain the ends and advantages mentioned as well as others inherent therein. While the presently preferred embodiment of this invention is given for the purpose of disclosure, numerous changes in details of construction, and arrangement of parts can be made which will readily suggest themselves to those skilled in the art and which are encompassed within the spirit of the invention and the scope of the appended claims.

What is claimed is:

1. In a kinetic energy type pumping system, a circulation system including an input line and two return lines, the input line and the return lines having first and second ends, a double acting valve having a horizontal passageway, the first ends of the input and the return lines being in fluid communication with the passageway, the first end of the input line being in fluid communication with the passageway between the first ends of the return lines, horizontally aligned and opposed valve seats in the passageway between each of the first ends of the return lines and the first end of the input line, a valve ball positioned between the valve seats, the first end of the input line arranged to introduce circulating liquid around the valve ball, first and second pipes having first and second ends, each of the first ends thereof being in fluid communication with the horizontal passageway and one each of the first ends of the return lines, the second ends of the pipes adapted to be in fluid communication with fluid to be pumped, a check valve positioned in each of the pipes adjacent their upstream portions effective to permit inflow of pumped fluid into the return lines through the check valves but preventing flow therefrom into the pipes, a discharge line in fluid communication with the circulation system, circulating liquid input means operable to introduce the circulating liquid into the input line, whereby the circulation system operates to cause a pumping action by the circulating liquid from the input line entering the passageway of the double acting valve thereby causing alternate seating of the valve ball on the opposed valve seats, thus alternate flow through the return lines thereby producing alternate suction in the pipes and corresponding opening and closing of the check valves, opening of each of the check valves permitting the produced suction through the opened check valve into its pipe to thereby pump fluid through the open check valve from its pipe into its return line, and to pump the circulating liquid and pumped liquid from the return line into the discharge line, and pressure dampening means in extensions of the input line below the double acting valve and at the top of the input line operable to dampen instantaneous pressure rises and drops caused by opening and closing of the double acting valve.

2. The kinetic energy type pumping system of claim 1, including, a (receptable) receptacle for receiving the circulating liquid and the pumped fluid, the discharge line being in fluid communication with a top portion (on) of the receptable for discharging the circulating liquid and the pumped fluid (and) adjacent the top portion of the receptacle, a liquid circulation line extending from adjacent a lower portion of the receptacle for circulating the circulating liquid from adjacent the lower portion thereof, the (means for) circulating (the liquid comprising) liquid input means including a circulation pump connected to the circulating liquid line, the liquid circulating line including a line (extension) extending into the input line, a discharge line from the circulation pump to the input line, a discharge line from the circulation pump to the input line, valves in the (circulation) circulating line upstream and downstream of the circulation pump and in the discharge line from the circulation pump, whereby the circulation pump can be stopped once the pumping operations have commenced and flow of circulating liquid into the imput line bypasses the circulating pump.

3. The kinetic energy type pumping system of claim 1, where, each of the check valves has a cage having an annular valve seat at its lower portion, a valve ball seating on the annular valve seat, the cage having a strip like valve ball retaining member extending from one side of the valve seat upwardly and over the valve ball and downwardly to an opposite side of the valve seat permitting limited upward movement of the valve ball off its annular seat and providing large upper surface areas of the valve ball of each of the check valves exposed to downward flow of the circulating liquid and effective to provide the rapid closing of the check valves.

4. In a kinetic energy type pumping system, a circulation system including an input line and two return lines, the input line and the return lines having first and second ends, a double acting valve having a horizontal passageway, the first ends of the input and the return lines being in fluid communication with the passageway, the first end of the input line being in fluid communication with the passages between first ends of the return lines, horizontally aligned and opposed valve seats in the passageway between each of the first ends of the return lines and the first end of the input line, a valve ball positioned between the valve seats, the first end of the input line arranged to introduce circulating liquid around the valve ball, first and second pipes having first and second ends, one each of the first ends thereof being in fluid communication with the horizontal passageway and one each of the first ends of the return lines, the second ends of the pipes adapted to be in fluid communication with fluid to be pumped, a check valve positioned in each of the pipes adjacent their upstream portions effective to permit inflow of pumped fluid into the return lines through the check valve but preventing flow therefrom into the pipes, a discharge line in fluid communication with the circulating system, circulating liquid means operable to introduce the circulating liquid into the input line, each of the check valves having a cage having an annular valve seat at its lower portion, a valve ball seating on the annular valve seat, the cage having a strip like valve ball retaining member extending from one side of the valve seat upwardly and over the valve ball and downwardly to an opposite side of the valve seat permitting limited upward movement of the valve ball off its annular seat and providing large upper surface areas of the valve ball of each of the check valves exposed to downward flow of the circulating liquid and effective to provide rapid closing of the check valves, the circulating system operable to cause a pumping action by the circulating liquid from the input line entering the passageway of the double acting valve thereby causing alternate seating of the valve ball on the opposed valve seats, thus alternate flow through the return lines thereby producing alternate suction in the pipes and corresponding opening of each of the check valves permitting the produced suction through the open check valve into its pipe to thereby pump fluid through the opened check valve from its pipe and to pump the circulating liquid and pumped liquid from the return line into the discharge line, pressure dampening means in extensions of the input line below the double acting valve and at the top of the input line operable to dampen instantaneous pressure rises and drops caused by opening and closing of the double acting valve, a receptacle for receiving the circulating liquid and the pumped fluid, the discharge line being in fluid communication with a top portion of the receptacle for discharging the circulating liquid and pumped fluid adjacent the top portion of the receptacle, a liquid circulation line extending from adjacent a lower portion of the receptacle for circulating the circulating liquid from adjacent the lower portion thereof, the circulating liquid means including a circulation pump connected to the circulating liquid line, the circulating liquid line including a line extending into the input line, a discharge line from the circulation pump to the input line, and valves in the circulation line upstream and downstream of the circulation pump and in the discharge line from the circulation pump, whereby the circulation pump can be stopped once the pumping operations have commenced and flow of circulating liquid into the input line bypasses the circulating pump.

* * * * *

UNITED STATES PATENT OFFICE

CERTIFICATE OF CORRECTION

Patent No. 4,121,895 Dated October 24, 1978

Inventor(s) John P. Watson

It is certified that error appears in the above-identified patent and that said Letters Patent are hereby corrected as shown below:

Column 4, line 37, after the word "the", add the word "input"

Column 4, line 38, change the "p" in the word "perforations" to a "P"

Column 4, line 59, change the word "attheir" to "at their"

Column 5, line 5, change the word "completely" to "complete"

Column 5, line 23, change the word "valves" to "valve"

Column 5, line 58, change the word "inpuet" to "input"

Column 10, line 58, change the word "circulating" to "circulation"

Signed and Sealed this

*Sixteenth* Day of *January 1979*

[SEAL]

*Attest:*

RUTH C. MASON
*Attesting Officer*

DONALD W. BANNER
*Commissioner of Patents and Trademarks*